US011174530B2

(12) United States Patent
Aarnts et al.

(10) Patent No.: US 11,174,530 B2
(45) **Date of Patent: *Nov. 16, 2021**

(54) STEEL FOR PAINTED PARTS

(71) Applicant: TATA STEEL IJMUIDEN B.V., Velsen-Noord (NL)

(72) Inventors: Maxim Peter Aarnts, Castricum (NL); Job Anthonius Van Der Hoeven, Haarlem (NL); Edgar Matthijs Toose, Hoofddorp (NL)

(73) Assignee: TATA STEEL IJMUIDEN B.V., Velsen-Noord (NL)

( * ) Notice: Subject to any disclaimer, the term of this patent is extended or adjusted under 35 U.S.C. 154(b) by 0 days.

This patent is subject to a terminal disclaimer.

(21) Appl. No.: 16/340,272

(22) PCT Filed: Oct. 13, 2017

(86) PCT No.: PCT/EP2017/076181
§ 371 (c)(1),
(2) Date: Apr. 8, 2019

(87) PCT Pub. No.: WO2018/073115
PCT Pub. Date: Apr. 26, 2018

(65) Prior Publication Data

US 2020/0040424 A1 Feb. 6, 2020

(30) Foreign Application Priority Data

Oct. 17, 2016 (EP) ..... 16194225

(51) Int. Cl.
*C21D 9/48* (2006.01)
*C21D 8/02* (2006.01)
(Continued)

(52) U.S. Cl.
CPC ..... *C21D 9/48* (2013.01); *C21D 8/0226* (2013.01); *C21D 8/0236* (2013.01);
(Continued)

(58) Field of Classification Search
None
See application file for complete search history.

(56) References Cited

U.S. PATENT DOCUMENTS 5,820,704 A 10/1998 Veyer et al.
5,853,903 A * 12/1998 Hosoya ..... C22C 38/12 428/669

(Continued)

FOREIGN PATENT DOCUMENTS

CN 105939793 A 9/2016
EP 0816524 A1 1/1998

(Continued)

OTHER PUBLICATIONS

Leonard, Ralph. "Continuous Hot Dip Coatings." ASM Handbook, vol. 13A: Corrosion: Fundamentals, Testing, and Protection S.D. Cramer, B.S. Covino, Jr., editors, p. 786-793. 2003. (Year: 2003).*

(Continued)

*Primary Examiner* — Brian D Walck
(74) *Attorney, Agent, or Firm* — Vorys, Sater, Seymour and Pease LLP

(57) ABSTRACT

A steel strip, sheet or blank used for painted parts, wherein the steel strip, sheet or blank is optionally metallic coated. According to the invention, the steel has grains with an essentially equi-axed median grain size smaller than 11.0 micrometer, resulting in a difference in Waviness $\Delta Wsa \leq 0.12$ μm between the surface before and after the forming of the strip, sheet or blank.
The invention also relates to a method for producing such a steel strip.

27 Claims, 1 Drawing Sheet

(51) Int. Cl.

| | |
|---|---|
| ***C22C 38/00*** | (2006.01) |
| ***C22C 38/04*** | (2006.01) |
| ***C23C 2/06*** | (2006.01) |
| ***C23C 2/12*** | (2006.01) |

(52) U.S. Cl.
CPC ..... *C22C 38/004* (2013.01); *C22C 38/04* (2013.01); *C23C 2/06* (2013.01); *C23C 2/12* (2013.01); *C21D 2201/05* (2013.01)

(56) References Cited

U.S. PATENT DOCUMENTS

| | | | | |
|---|---|---|---|---|
| 2009/0246472 | A1 | 10/2009 | Kanai et al. | |
| 2009/0272468 | A1 | 11/2009 | Han et al. | |
| 2013/0240094 | A1 | 9/2013 | Akamatsu et al. | |
| 2013/0323112 | A1* | 12/2013 | Okamoto ..... | C22C 38/001 420/83 |

FOREIGN PATENT DOCUMENTS

| | | | |
|---|---|---|---|
| EP | 2116311 | A1 | 11/2009 |
| JP | 2006061952 | A | 3/2006 |
| JP | 2006095518 | A | 4/2006 |
| JP | 2006265614 | A | 10/2006 |
| WO | 2007035059 | A1 | 3/2007 |
| WO | 2018073117 | A1 | 4/2018 |

OTHER PUBLICATIONS

International Search Report and Written Opinion dated Nov. 17, 2017 for PCT/EP2017/076181 to TATA STEEL IJMUIDEN B.V. filed Oct. 13, 2017.
Notification of Transmittal of the International Preliminary Report On Patentability dated Nov. 29, 2018 for PCT/EP2017/076181 to TATA STEEL IJMUIDEN B.V. filed Oct. 13, 2017.
Sep. 1941:May 2012, Beuth Publishing (May 2012).

* cited by examiner

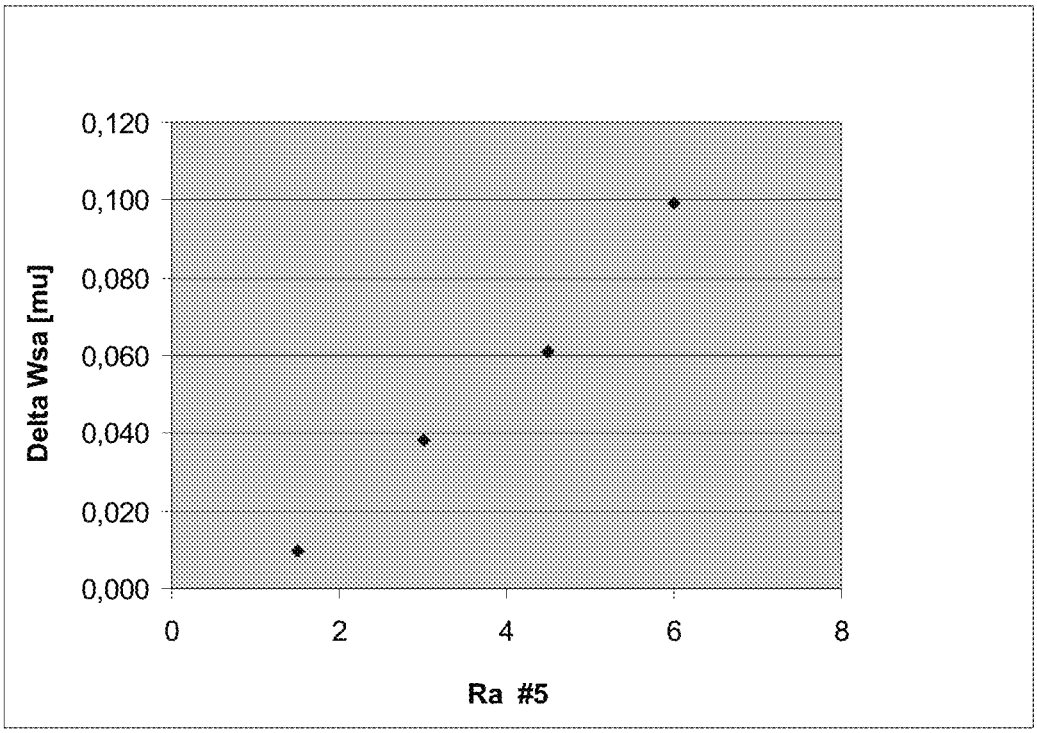
0,120
0,100
0,080
0,060
0,040
0,020
0,000
Delta Wsa [mu]
0
2
4
6
8
Ra #5

STEEL FOR PAINTED PARTS

CROSS-REFERENCE TO RELATED APPLICATIONS

This is a § 371 National Stage Application of International Application No. PCT/EP2017/076181 filed on Oct. 13, 2017, claiming the priority of European Patent Application No. 16194225.5 filed on Oct. 17, 2016.

The invention relates to a steel strip, sheet or blank used for painted parts, e.g. for automotive purposes. The invention also relates to a method for producing such a strip, sheet or blank.

Painted steel parts, e.g. for the outer panels of automobiles, such as the hood and the doors, are subject to stringent requirements by the producers thereof. One of these requirements relates to the paint appearance of the painted part.

The steel substrate for producing the painted parts is usually coated with a metal coating, e.g. zinc based coating. A manufacturer forms the (coated) substrate in a press into the desired shape for a panel. After pressing, the panels are usually painted using one or more layers of paint.

Outer panels with a very good paint appearance are highly valued, i.e. when the panels have a mirror-like surface that reflects light without distortion leading to sharp reflected images. The paint appearance is influenced by the quality of the paint, but also by the surface of the (coated) substrate. This surface consists of in-plane structures of variable size and amplitude. The smaller structures are captured by the surface roughness, whereas the larger structures are captured by the so-called surface waviness.

It is known to the person skilled in the art that the larger surface structures, e.g. the surface waviness, are transmitted through the different paint layers. As such the waviness of the surface of the (coated) substrate is to a certain extent still present at the surface of the outer paint layer. The paint appearance of the painted part can be measured and is expressed by different measured values, e.g. Long Waviness LW in case it is measured using a BYK Wavescan Dual. Due to the transmission effect the Long Waviness, or a similar value, of the painted part is related to the surface waviness of the non-painted formed part. A typical relation between LW and the waviness of the (coated) substrate surface is for instance given in the Cannes Conference: Lightweight Design: New High Performance Steel with Optimized Paint Appearance for New Car Bodies, Matthijs Toose, 28$^{th}$ International Conference on Automotive Body Finishing "Surcar", Jun. 18-19 2015, Cannes, or the Bad Nauheim conference: Car Body Painting 2015, 32$^{nd}$ Workshop of the 1$^{st}$ German Automotive Circle, 9-10 Nov. 2015, Bad Nauheim. It is important to realize the surface waviness should be measured after pressing or forming has been applied.

It is know to the person skilled in the art that the surface waviness of a formed part is the result of the surface waviness of the undeformed, e.g. flat part, and the waviness increase introduced by the forming step. The difference between the waviness of the formed part and the waviness of the undeformed part is referred to as the delta waviness, e.g. ΔWsa. Due to the specific nature of the production process for strip products the formed surface shows a line like pattern, in which the lines are perpendicular to the rolling direction. An implication of this observation is that the delta waviness is higher in the rolling direction than in other directions. This directional effect is strongly present in the paint appearance values as well and therefore it is of importance that delta waviness in the rolling direction is minimized as much as possible.

SUMMARY OF THE INVENTION

It is an object of the present invention to provide a steel strip, sheet or blank meant for painted parts, having a waviness that provides a good paint appearance.

It is another object of the invention to provide a method by which a steel strip can be produced with a waviness that provides a good paint appearance.

It is a further object of the invention to provide a steel strip, sheet or blank of which the delta waviness can be controlled.

BRIEF DESCRIPTION OF THE DRAWING

FIG. 1 shows the ΔWsa that was obtained in four experiments of the Examples.

DETAILED DESCRIPTION

According to the invention, a steel strip, sheet or blank used for painted parts, which strip, sheet or blank is optionally metallic coated, is provided of which the steel substrate has grains with an essentially equi-axed median grain size smaller than 11.0 micrometer, resulting in a delta Waviness ΔWsa≤0.12 μm of the surface due to the forming of the strip, sheet or blank, ΔWsa defined as Wsa(Formed) minus Wsa (Flat) in which Wsa(Formed) is the Wsa value of the optionally metallic coated substrate surface after the forming and Wsa(Flat) is the Wsa value of the optionally metallic coated substrate surface before the forming.

The inventors have found that the grain size is one of the most determining factors for waviness, and especially for determining ΔWsa. By determining the grain size and the ΔWsa of numerous steel samples the inventors have been able to determine a relationship between grain size and ΔWsa, with essentially equi-axed grains with median grain size smaller than 11.0 micrometer resulting in a ΔWsa≤0.12 μm of the surface of the strip, sheet or blank. Wsa is defined in standard SEP 1941. The relationship between grain size and ΔWsa makes it possible to produce steel strips, sheets and blanks having a desired ΔWsa≤0.12 μm when the grain size of the steel substrate is controlled. The grain size is the size of the grains after continuous annealing and optionally metallic coating.

Essentially equi-axed means that, in a cross section (RD/ND plane), the number of grain boundaries intersecting with a straight line parallel to RD, divided by the number of grain boundaries intersecting with a straight line of equal length in ND is at least 0.66; the straight line should be long enough to yield at least 200 intersects in RD as well as in ND, or the procedure is repeated with several equally distributed lines such that the sum of all intersects in RD as well as in ND is at least 200. In the latter case the number of intersects in RD and ND is totaled over the lines before they are divided. The inventors used the following procedure:

In a cross section (RD/ND plane) the number of grain boundaries intersecting with 10 straight lines, equally distributed over ND (normal direction) and parallel to RD (rolling direction) were measured. Also the numbers of grain boundaries intersecting with 10 straight lines, equally distributed over RD, and parallel to ND were measured. The lines in RD and ND were of equal length and long enough to yield at least 20 grain boundary intersects per line. The total number of intersects over all lines in RD was divided by the total number of intersects over all lines in ND, and in all cases this number was ≥0.66.

Having essentially equi-axed grains with median grain size smaller than 11.0 micrometer is an important condition but other conditions are important as well to get the best results. The roughness at the last stand of the cold mill, as well as the roughness of the temper mill, and the reductions given at the last stand of the cold mill and at the temper mill are parameters that need to be controlled; this is known for the person skilled in the art.

Preferably the essentially equi-axed grains have a median size smaller than 10.0 micrometer, resulting in a ΔWsa≤0.10. The smaller the grain size, the lower ΔWsa will be.

According to a preferred embodiment, the optionally metallic coated strip, sheet or blank before the forming has a waviness Wsa≤0.35 μm where Wsa is measured in the rolling direction, preferably a waviness Wsa≤0.32 μm, even more preferably Wsa≤0.29 μm and even more preferably Wsa≤0.26 μm. The waviness of the undeformed steel surface in combination with ΔWsa determines the Wsa of the formed part.

According to a second aspect of the invention a steel strip, sheet or blank is provided wherein the steel is an Ultra Low Carbon (ULC) steel type having a composition of (in weight %):

C: max 0.007, more preferred max 0.005
Mn: max 1.2, more preferred max 1.0, even more preferred max 0.8
Si: max 0.5, more preferred max 0.25
P: max 0.15, more preferred max 0.1
S: 0.003-0.045, more preferred 0.005-0.02
Al: max 0.1, more preferred 0.01-0.1
N: max 0.01, more preferred max 0.006
Ti, Nb, Mo:
if Ti≥0.005 and Nb≥0.005:
0.06≤4Ti+4Nb+2Mo≤0.60
otherwise
0.06≤Ti+2Nb+2 Mo≤0.60
and one or more of the optional elements:
Cu: max 0.10, more preferred max 0.04
Cr: max 0.06, more preferred max 0.04
Ni: max 0.08, more preferred max 0.04
B: max 0.0015, more preferred 0.0005-0.0008
V: max 0.01, more preferred as impurity only
Ca: max 0.01, more preferred max 0.005
Co: max 0.01, more preferred as impurity only
Sn: max 0.01, more preferred as impurity only
the remainder being iron and unavoidable impurities.

Ultra Low Carbon Steels are often meant for applications demanding high formability. Carbon in Ultra Low Carbon steels should be kept low because for deepdrawing any Carbon in solid solution has a deleterious effect on the preferred recrystallisation texture. In IF (interstitial free) steels, which are a special type of ULC steels, all Carbon is precipitated to avoid any Carbon in solid solution. In BH (bake hardenable) steel, which is also a special type of ULC steel, a limited level of Carbon is kept in solid solution to benefit from a strength increase during baking, and the remaining Carbon should also be precipitated. In both cases the total level of Carbon should not be more than 0.007 wt % otherwise the amount and size of formed precipitates will hamper formability. To further improve formability, it is preferred to have not more than 0.005 wt % Carbon in the alloy of the current invention.

Manganese is a solid solution strengthening element and can therefore be added to increase the strength but it has a negative effect on deep drawability. For this reason the Mn level should be kept to max 1.2 wt %. Furthermore, the formation of MnS might hamper the formation of the preferred Ti4C2S2 precipitates. For the latter reason, and to not compromise formability too much, it is preferred to have max 1.0 wt % Mn, or even more preferred to have max 0.8 wt % Mn.

Silicon is also a solid solution strengthening element and can therefore be added to increase the strength. However, if the Si level is too high the coating adhesion might deteriorate due to the forming of Mn2SiO4 spinel type oxides, and/or SiO2. For this reason the maximum Si level is 0.5 wt %, more preferred max 0.25 wt %.

Phosphorus is a very potent solution strengthening element but high levels of P might increase the Ductile-to-Brittle-Transition-Temperature (DBTT) too much, in particular in IF steels. Adding Boron can counteract this, nevertheless the P level should be maximum 0.15 wt %. Furthermore, high levels of P will increase the change to the formation of Fe—Ti—P precipitates which are not desired. For this reason it is preferred to keep maximum P level at 0.10 wt %.

Sulphur is necessary to make sure the preferred Ti4C2S2 precipitate is formed. However, if the level of S is too high the formation of TiC is suppressed during hot rolling, which will lead to fast recrystallisation followed by grain growth. It is therefore important for the current invention to limit the S to maximum 0.045 wt %, more preferably maximum 0.02 wt %.

Aluminium is mainly added to bind any remaining oxygen, but it can also be used to precipitate with Nitrogen. To bind oxygen a minimum aluminium level of 0.01 wt % is preferred. With increasing aluminium level, the risk for clogging during casting also increases. For this reason the maximum level of Al is set at 0.1 wt %.

Nitrogen in solid solution is present as an interstitial element which hampers formability. It should therefore be fully precipitated. Usually Ti, Al or B are added to make sure all N has precipitated. Nevertheless the N level should not exceed 0.01 wt % and the amount of N should preferably be not more than 0.006 wt %.

Titanium, Niobium and Molybdenum are strong grain refiners and the presence of at least one of these elements is essential for the current invention. Nb and Mo are even more potent as grain refiners than Ti; based on the observations by the inventors, Nb and Mo are about 2 times more effective (when given in wt %). Furthermore, when Ti and Nb are both present, they enhance each other such that their combined presence is about 4× more effective as grain refiner compared to only Ti. These elements work because they precipitate with N and/or C and the precipitates formed hinder recrystallisation and grain growth; Nb is also known to hinder recrystallisation and grain growth when in solid solution. Vanadium might also work, but Vanadium precipitates can dissolve at the temperatures used for annealing after cold rolling which renders these precipitates less effective.

For BH alloys, the amount of Carbon in solid solution is important and needs to be controlled. Because Ti, Nb Mo and V precipitate with Carbon they are also important to control the amount of C in solid solution. For BH steels, the balance between C, N, Ti, Mo, V and Nb needs to be tuned with care. In IF steels some excess Ti or Nb can be allowed. This, in combination with the required grain refining effect, limits Ti between 0.06 and 0.60 wt %, or Nb between 0.03 and 0.30 wt % or Mo between 0.03 and 0.30 wt %;

combinations of these three elements are also possible in which case 4×(Ti+Nb)+2×Mo should be from 0.06 to 0.6 wt %.

The inventors have found that Ultra Low Carbon steel types, which are mainly used for painted parts such as outer panels of automobiles, increase the chance of providing grains with the right size—that is an average size of less than 11.0 micrometer as essentially equi-axed grains—when the composition of the steel is as indicated above. It has been found by the inventors that the amount of Ti, Nb and Mo is especially important. The amount of Ti or 2×Nb or 2×Mo must be at least 0.06 wt %, or when these elements are combined the amount of 4×(Ti+Nb)+2×Mo must be at least 0.06 wt %. At a lower level of Ti or Nb or Mo or the combination, the grain refinement of the steel will be too low, meaning that the grains will have a size that is on average larger than 11.0 micrometer. When more than 0.60 wt % Ti or more than 0.30 wt % Nb or more than 0.30 wt % Mo is used, or when these elements are combined an amount of 4×(Ti+Nb)+2Mo (all in wt %) being more than 0.6 is used, no influence on the further grain refinement can be measured or the grain refining effect might even deteriorate.

Copper is allowed up to 0.10 wt %. It can lead to the formation of CuS which with the right dimensions might hinder recrystallisation and grain growth but it is also in competition with the more desirable Ti4C2S2. Therefore, a maximum level of 0.04 wt % is more preferred.

Chromium and Nickel are basically impurities but a maximum of 0.06 and 0.08 wt % respectively does not harm. Nevertheless, a maximum of 0.04 wt % for each is more preferred.

Boron is an interstitial element so Boron in solid solution should be kept as low as possible, restricting B to maximum 0.0015 wt %. Boron can be added to reduce the chance for a too high DBTT, in particular in P alloyed IF steels. It can also be added to make sure all N is precipitated. On the other hand more than 0.0008 wt % B might lead to surface defects, so the more preferred range is 0.0005-0.0008 wt % B.

Cobalt and Tin are basically impurities but maximum 0.04 wt % for both can be allowed.

Calcium is sometimes added up to 0.005 wt % in steels for deoxidation and/or desulphurisation. A level up to 0.01 wt % can be allowed without deteriorating the properties.

Preferably, in the above composition of ULC steel the amounts of Ti, Nb and Mo are as follows (in weight %):

if Ti≥0.005 and Nb≥0.005:

$0.06 \leq 4Ti+4Nb+2Mo \leq 0.30$ otherwise $0.06 \leq Ti+2Nb+2Mo \leq 0.10$.

Preferably, the upper limit for the formula for the combination of Ti, Nb and Mo is 0.30, because it is unusual that these elements are needed in such high amounts. For the same reason, in case Ti and/or Nb≤0.005 the more preferred upper level is 0.1 wt %.

According to a preferred embodiment Bake Hardenable ultra low carbon steel strip, sheet or blank is used, wherein the amount of Ti, Nb and Mo are tuned with respect to the C, N and S levels as follows (all in wt %):

$Ti(free)=Ti-3.43N-1.5S$ if $Ti(free) \leq 0$ than $Ti(c)=0$, else $Ti(c)=Ti(free)$ and $Csol=C-0.125Mo-0.129Nb-0.25Ti(c)$ such that $0.0008 \leq Csol \leq 0.0033$ and furthermore if Ti and Nb are both >0.005 wt %

$0.06 \leq 4(Ti+Nb)+2Mo \leq 0.60$ wt % otherwise: $0.06 \leq Ti+2Nb+2Mo \leq 0.60$ wt %.

For a BH steel (Bake Hardenable steel) some free carbon (Csol) is essential for the bake hardening response, hence the lower limit on Csol; a too high level of Csol can lead to fast natural ageing instead of a bake hardening effect, hence the upper limit of Csol.

Preferably the strip, sheet or blank is coated with a zinc based coating, a Zn—Al—Mg based coating, or an aluminium based coating. Preferably the zinc based coating consists of 0.1-1.2 wt % aluminium and up to 0.3 wt % of other elements, the remainder being unavoidable impurities and zinc, or the Zn—Al—Mg based coating preferably consists of 0.2-3.0 wt % aluminium and 0.2-3.0 wt % magnesium, up to 0.3 wt % of other elements, the remainder being unavoidable impurities and zinc, or the aluminium based coating preferably consists of 0.2-13 wt % silicon, up to 0.3 wt % of other elements, the remainder being unavoidable impurities and aluminium.

These coating are used in the automotive industry and are therefore preferably used to coat the steel strip, sheet or blank. The other elements mentioned can be Si, Sn, Bi, Sb, Ln, Ce, Ti, Sc, Sr and/or B.

According to a third aspect of the invention a method for producing a steel strip according to the first or second aspect of the invention is provided, wherein the steel strip is hot rolled and cold rolled, and wherein the last stand or the only stand for the cold rolling contains work rolls having a roughness Ra between 0.5 μm and 7.0 μm.

The inventors found that work rolls in the last stand of the cold mill having a roughness Ra between 0.5 μm and 7.0 μm can be used, when the grain size of the steel strip is fine enough, as indicated for the first aspect of the invention. It is known to a person skilled in the art that lowering the last stand cold mill roughness would be beneficial to reduce the Wsa value after forming even further. However, the inventors have found that it is not required to use work rolls in the last stand of the cold mill having a roughness Ra lower than 0.5 μm. To use work rolls that have a roughness Ra lower than 0.5 μm has disadvantages since they will need very special grinding operations to be prepared.

Preferably the roughness Ra of the work rolls in the last stand or the only stand is between 0.55 μm and 5.0 μm, more preferably between 0.6 μm and 4.0 μm, most preferably between 0.6 μm and 2.0 μm. The inventors have found that work rolls with a roughness between these limits provide good results.

When the cold rolling mill contains one stand, the work rolls should have a roughness Ra between 0.5 μm and 7.0 μm.

When the cold rolling mill contains two stands, the work rolls of the first stand should have a roughness Ra between 0.6 μm and 3.0 μm, and the work rolls of the last stand should have a roughness Ra between 0.5 μm and 7.0 μm.

When the cold rolling mill contains three or more stands, the work rolls of the first stand should have a roughness Ra between 0.6 μm and 3.0 μm, the work rolls of the intermediate stands should have a roughness Ra between 0.3 μm and 0.8 μm and the work rolls of the last stand should have a roughness Ra between 0.5 μm and 7.0 μm.

The above shows that that the inventors have found that the work rolls used before the strip leaves the cold rolling mill always should have a roughness Ra between 0.5 μm and 7.0 μm. When a separate first stand is used, the roughness thereof should be between 0.6 μm and 3.0 μm. If intermediate stands are present, these should have a low roughness: between 0.3 μm and 0.8 μm.

When in the above cases a roughness Ra between 0.5 μm and 7.0 μm is indicated, it should be understood that also the more limited ranges can apply.

Preferably the cold rolled strip is skin passed, preferably after applying a metallic coating, using temper rolls having a roughness between 0.5 and 4.0 μm, preferably a roughness 2.8 μm. The roughness of the skin pass rolls is transferred on the strip, sheet of blank that is formed, which has a clear influence on the waviness of the flat product.

TABLE 1 chemistries of the used samples

| | | all in wt % | | | | | | | | | | | | | | | |
|---|---|---|---|---|---|---|---|---|---|---|---|---|---|---|---|---|---|
| alloy | type | C | Mn | P | S | Si | Al_sol | Cu | Sn | Cr | Ni | Mo | Nb | V | B | Ti | N |
| 1A | BH | 0.0015 | 0.185 | 0.05 | 0.012 | 0.003 | 0.048 | 0.025 | 0.004 | 0.019 | 0.023 | 0.002 | 0 | 0.001 | 0.0007 | 0.001 | 0.0012 |
| 1B | BH | 0.0015 | 0.185 | 0.05 | 0.012 | 0.003 | 0.048 | 0.025 | 0.004 | 0.019 | 0.023 | 0.002 | 0 | 0.001 | 0.0007 | 0.001 | 0.0012 |
| 2A | IF | 0.0012 | 0.094 | 0.005 | 0.008 | 0.003 | 0.049 | 0.014 | 0.002 | 0.02 | 0.016 | 0.005 | 0 | 0.001 | 0 | 0.047 | 0.0021 |
| 2B | IF | 0.0012 | 0.094 | 0.005 | 0.008 | 0.003 | 0.049 | 0.014 | 0.002 | 0.02 | 0.016 | 0.005 | 0 | 0.001 | 0 | 0.047 | 0.0021 |
| 2C | IF | 0.0012 | 0.094 | 0.005 | 0.008 | 0.003 | 0.049 | 0.014 | 0.002 | 0.02 | 0.016 | 0.005 | 0 | 0.001 | 0 | 0.047 | 0.0021 |
| 3 | IF | 0.0006 | 0.046 | 0.006 | 0.006 | 0.004 | 0.055 | 0.014 | 0.003 | 0.013 | 0.016 | 0.004 | 0 | 0.001 | 0 | 0.046 | 0.002 |
| 4A | IF | 0.002 | 0.103 | 0.006 | 0.006 | 0.004 | 0.054 | 0.012 | 0.003 | 0.018 | 0.018 | 0.005 | 0 | 0.002 | 0 | 0.043 | 0.0021 |
| 4B | IF | 0.002 | 0.103 | 0.006 | 0.006 | 0.004 | 0.054 | 0.012 | 0.003 | 0.018 | 0.018 | 0.005 | 0 | 0.002 | 0 | 0.043 | 0.0021 |
| 5 | IF | 0.001 | 0.096 | 0.005 | 0.006 | 0.003 | 0.059 | 0.012 | 0.001 | 0.018 | 0.019 | 0.006 | 0 | 0.001 | 0 | 0.045 | 0.0013 |
| 6 | IF | 0.0017 | 0.105 | 0.005 | 0.007 | 0.004 | 0.053 | 0.015 | 0.002 | 0.018 | 0.02 | 0.005 | 0 | 0.002 | 0 | 0.044 | 0.0022 |
| 7 | BH | 0.0029 | 0.137 | 0.006 | 0.007 | 0.003 | 0.041 | 0.015 | 0.002 | 0.015 | 0.018 | 0.004 | 0.007 | 0.001 | 0.0008 | 0.008 | 0.0028 |
| 8A | BH | 0.0027 | 0.127 | 0.009 | 0.007 | 0.004 | 0.044 | 0.011 | 0.005 | 0.02 | 0.013 | 0.003 | 0.007 | 0.001 | 0.001 | 0.009 | 0.0025 |
| 8B | BH | 0.0027 | 0.127 | 0.009 | 0.007 | 0.004 | 0.044 | 0.011 | 0.005 | 0.02 | 0.013 | 0.003 | 0.007 | 0.001 | 0.001 | 0.009 | 0.0025 |
| 9A | IF | 0.0027 | 0.071 | 0.008 | 0.009 | 0.004 | 0.042 | 0.035 | 0.007 | 0.025 | 0.022 | 0.002 | 0.001 | 0.003 | 0.0002 | 0.065 | 0.0029 |
| 9B | IF | 0.0027 | 0.071 | 0.008 | 0.009 | 0.004 | 0.042 | 0.035 | 0.007 | 0.025 | 0.022 | 0.002 | 0.001 | 0.003 | 0.0002 | 0.065 | 0.0029 |
| 10 | IF | 0.0028 | 0.077 | 0.01 | 0.009 | 0.006 | 0.053 | 0.055 | 0.01 | 0.022 | 0.024 | 0.002 | 0.001 | 0.003 | 0.0002 | 0.067 | 0.0032 |
| 11 | IF | 0.0017 | 0.127 | 0.009 | 0.008 | 0.003 | 0.03 | 0.013 | 0.004 | 0.018 | 0.011 | 0.003 | 0.017 | 0.001 | 0 | 0.016 | 0.002 |
| 12 | IF | 0.0014 | 0.122 | 0.01 | 0.008 | 0.003 | 0.024 | 0.028 | 0.004 | 0.021 | 0.013 | 0.005 | 0.016 | 0.001 | 0 | 0.015 | 0.0022 |

According to a fourth aspect of the invention a strip produced with the method according to the third aspect of the invention is produced, wherein the surface of the strip has a roughness Ra lower than 2.0 μm and a waviness Wsa lower than 0.6 μm in rolling direction of the strip for a strip coated with an aluminium based coating having a coating thickness between 4 and 12 μm.

Preferably, the strip has a roughness Ra between 0.7 and 1.6 μm and a waviness Wsa between 0.15 and 0.35 μm in rolling direction of the strip.

EXAMPLES

For several BH and IF alloys the grain size was determined as well as the waviness Wsa before and after cupping.

All samples came from coils that were cold rolled on a 5 stand cold mill. The first stand had a ground roughness with Ra 1.2±0.2 μm; the second, third and fourth stand had a ground roughness with Ra 0.6±0.2 μm. The last stand had an EDT roughness with Ra 4.5±0.2 μm. After cold rolling, the coils were continuously annealed, top temperature 810±20° C., and hot dip galvanised at 470±10° C. Air knives were used to adjust the coating thickness, and cooling was applied immediately after the air knives to solidify the coating. Finally, the strip was temper rolled. The roughness of the temper mill was EDT 1.9±0.1 μm.

The chemistries of these alloys is given in table 1.

Grain size was determined as follows:

Sample Preparation

RD-ND sections of the samples were mounted in conductive resin (so called polyfast) and mechanically polished to 1 μm. Care was taken to remove any surface deformation caused by the previous grinding and polishing steps. To obtain a fully deformation free surface, the final polishing step was conducted with colloidal silica.

SEM

The microstructure analysis was performed using a FEG-SEM (Field Emission Gun scanning electron microscope, Zeiss Ultra 55 FEG-SEM) equipped with an EDAX PEGASUS XM 4 HIKARI EBSD system. EBSD (Electron Backscatter Diffraction) scans of reported samples were performed using typically the following SEM settings:

The EBSD scans were collected on the RD-ND plane of the samples. The samples were placed under a 70° angle in the SEM. The acceleration voltage was 15 kV, the high current option was on, the 120 μm aperture was used and typically the working distance was 17 mm during scanning. To compensate for the 70° tilt angle of the sample the dynamic focus correction was used during scanning.

EBSD Data Collection

The EBSD scans were captured using software from firm EDAX (TSL OIM Data Collection version 7.0.1. (8-27-13)). Typically the following data collection settings were used: Hikari camera at 6×6 binning combined with standard background subtraction. The scan area was in all cases at most the sample thickness, and care was taken not to include non metallic inclusions in the scan area.

EBSD Scan size: 500×500 μm, step size 0.5 μm. scan rate ca. 80 frames per second, phase included during scanning: Fe(a). The Hough settings used during data collections were: Binned pattern size ~96; theta set size: 1; rho fraction ≈90; max peak count: 13; min peak count: 5; Hough type: classic; Hough resolution: low; butterfly convolution mask: 9×9; peak symmetry: 0.5; min peak magnitude: 5 max peak distance: 15.

EBSD Data Evaluation

The EBSD scans were evaluated with TSL OIM Analysis software version 7.1.0×64 (30-14-14). Typically, the data sets were 90° rotated over RD to get the scans in the proper orientation with respect to the measurement orientation. A standard grain dilation clean up was performed (GTA 5, minimum grain size 5 and grain must contain multiple rows single iteration).

Surface profiles were measured by using skidless stylus device with a tip radius of 2 μm. Per sample five tracks of 70 mm length and a point density of 1000 points/mm were made. Wsa was calculated according to SEP1941 whereas the roughness was calculated according the ISO 4287 in which a cut-off of 2.5 mm was used. Per sample the arithmetic mean of the five tracks was determined to give the specific value under consideration, i.e. roughness or waviness.

Cups were produced by pressing a blank of 145 mm×145 mm in a press with a hollow punch with diameter 75 mm and a blankholder force such that any material movement of the (coated) substrate between the blankholder and die is completely suppressed. The deformation of the cup is such that the thickness strain in the bottom is 9%+/−0.3%. Here the thickness strain is defined as (t(original)−t(deformed))/t(original)×100%, with t(original) the undeformed thickness and t(deformed) the thickness after deformation.

The results are shown in table 2. The table indicates that in order to increase the chance for ΔWsa 0.12 μm, the grain size of the material needs to be smaller than 11.0

TABLE 2 measured grain size, delta Wsa and "effectiveness of Ti/Nb/Mo"; delta Wsa >0.12 is presented by 'x' and delta Wsa ≤0.12 is presented by "○" "effectiveness of Ti/Nb/Mo" is: if Ti and Nb are both ≥ 0.005 wt %: 4(Ti + Nb) + 2Mo otherwise Ti + 2Nb + 2Mo

| alloy | grain size | delta Wsa | effectiveness Ti/Nb/Mo |
|---|---|---|---|
| 1A | 13.9 | x | 0.005 |
| 1B | 15.2 | x | 0.005 |
| 2A | 14.1 | x | 0.057 |
| 2B | 13.0 | x | 0.057 |
| 2C | 15.3 | x | 0.057 |
| 3 | 14.5 | x | 0.054 |
| 4A | 9.3 | ○ | 0.053 |
| 5 | 13.6 | x | 0.057 |
| 4B | 11.2 | x | 0.053 |
| 6 | 11.2 | x | 0.054 |
| 7 | 9.7 | ○ | 0.068 |
| 8A | 8.7 | ○ | 0.070 |
| 8B | 9.8 | ○ | 0.070 |
| 9A | 10.3 | ○ | 0.071 |
| 9B | 11.0 | ○ | 0.071 |
| 10 | 10.3 | ○ | 0.073 |
| 11 | 10.5 | ○ | 0.138 |
| 12 | 10.8 | ○ | 0.134 |

Alloy 4A has a grain size ≤11.0 μm which does lead to ΔWsa≤0.12 although the "effectiveness of Ti/Nb/Mo"<0.06. This indicates that even when the "effectiveness of Ti/Nb/Mo" is too low, good products are possible but good results are not usual.

The inventors have found that the ΔWsa is indeed very much dependent on the median equi-axed grain size, both in regard to the upper limit as in regard to the lower limit of ΔWsa.

After the example described above, some further experiments were performed. In these experiments, the roughness of the rolls in the last stand of the cold mill was varied. All other parameters of the method used in the example above remained the same. The alloy used was a BH type, typical values for the chemistry are given in below, all elements in wt %.:

C=0.0029
Mn=0.132
P=0.009
S=0.007
Si=0.003
Al sol=0.044
Cu=0.013
Sn=0.004
Cr=0.019
Ni=0.016
Mo=0.003
Nb=0.0075
V=0.001
B=0.001
Ti=0.009
N=0.0021.

Apart from the roughness of the last stand of the cold mill, processing was performed as described above for the samples given in table 1. For the rolls in the last stand of the cold mill, a roughness with four different values was used. The roughness Ra of the rolls obtained by EDT technique was 1.5, 3.0, 4.5 and 6.0 μm, respectively. FIG. 1 shows the ΔWsa that was obtained in these four experiments; Ra values of the samples before cupping were between 1.05 and 1.2 μm, and the Rpc of the samples before cupping was between 80 and 105 $cm^{-1}$. (Rpc is the peak count, that is the number of roughness peaks per given length).

FIG. 1 shows that the roughness of the last stand of the cold mill can have a significant influence on the ΔWsa that is obtained.

The invention claimed is:

1. A steel strip, sheet or blank used for painted parts, wherein the steel strip, sheet or blank is optionally metallic coated, wherein the steel is an Ultra Low Carbon (ULC) steel type having a composition of (in weight %):

C: max 0.007
Mn: max 1.2
Si: max 0.5
Al: max 0.1
P: max 0.15
S: 0.003-0.045
N: max 0.01
Ti, Nb, Mo:
if Ti≥0.005 and Nb≥0.005:
0.06≤Ti+4Nb+2Mo≤0.60
otherwise
0.06≤Ti+2Nb+2Mo≤0.60
Cu: max 0.10
Cr: max 0.06
Ni: max 0.08
B: max 0.0015
V: max 0.01
Ca: max 0.01
Co: max 0.01
Sn: max 0.01 wherein C, Mn and Si are present, the remainder being iron and unavoidable impurities, wherein the steel strip, sheet or blank is an IF steel ultra low carbon steel strip, sheet or blank wherein the steel has grains with an essentially equi-axed median grain size smaller than 11.0 micrometer, resulting in a delta Waviness ΔWsa≤0.12 μm of the surface due to the forming of the strip, sheet or blank, according to a forming test wherein cups were produced by pressing a 145 mm×145 mm sample of the steel strip, sheet or blank in a press with a hollow punch with diameter 75 mm and a blankholder force such that any material movement of the (coated) substrate between the blankholder and then die is completely suppressed, wherein deformation of the cup is such that thickness strain in a bottom of the cup is 9%+0.3%, wherein Wsa is measured according to standard SEP 1941, ΔWsa defined as Wsa(Formed) minus Wsa(Flat), in which Wsa(Formed) is the Wsa value of the optionally metallic coated substrate surface after the forming and Wsa (Flat) is the Wsa value of the optionally metallic coated substrate surface before the forming, wherein Wsa(Flat) is lower than 0.6 μm in a rolling direction of the strip.

2. The steel strip, sheet or blank according to claim 1, wherein the essentially equi-axed grains have a median size smaller than 10.0 micrometer, resulting in a ΔWsa≤10.0.

3. The steel strip, sheet or blank according to claim 1, wherein the optionally metallic coated strip, sheet or blank before the forming has a waviness Wsa≤0.35 μm where Wsa is measured in the rolling direction.

4. The steel strip, sheet or blank according to claim 1, wherein Wsa (Flat) is ≤0.32 μm and the steel is an Ultra Low Carbon (ULC) steel type having a composition of (in weight %):

C: 0.0014-0.007
Mn: 0.0711.2
Si: 0.003-0.5
Al: 0.024-0.1
P: 0.006-0.15
S: 0.003-0.045
N: max 0.01
Ti, Nb, Mo:
if Ti≥0.005 and Nb≥0.005:
0.06≤Ti+4Nb+2Mo≤0.60
otherwise
0.06≤Ti+2Nb+2Mo≤0.60
and one or more of the optional elements:
Cu: max 0.10
Cr: max 0.06
Ni: max 0.08
B: max 0.0015
V: max 0.01
Ca: max 0.01
Co: max 0.01
Sn: max 0.01
the remainder being iron and unavoidable impurities.

5. The steel strip, sheet or blank according to claim 1, wherein the amounts of Ti, Nb and Mo are as follows (in weight %):

if Ti≥0.005 and Nb≥0.005:
0.06≤Ti+4Nb+2Mo≤0.30
otherwise 0.06≤Ti+2Nb+2 Mo≤0.10.

6. The strip, sheet or blank according to claim 1, wherein the strip, sheet or blank is coated with a zinc based coating, a Zn—Al—Mg based coating, or an aluminium based coating, wherein the zinc based coating consists of 0.1-1.2 wt % aluminium and up to 0.3 wt % of other elements, the remainder being unavoidable impurities and zinc, or the Zn—Al—Mg based coating consists of 0.2-3.0 wt % aluminium and 0.2-3.0 wt % magnesium, up to 0.3 wt % of other elements, the remainder being unavoidable impurities and zinc, or the aluminium based coating consists of 0.2-13 wt % silicon, up to 0.3 wt % of other elements, the remainder being unavoidable impurities and aluminium.

7. A method for producing a steel strip according to claim 1, wherein the steel strip is hot rolled and cold rolled, and the last stand or the only stand of the cold rolling mill contains work rolls having a roughness Ra between 0.5 μm and 7.0 μm.

8. The steel strip, sheet or blank according to claim 1, wherein the optionally metallic coated strip, sheet or blank before the forming has a waviness Wsa≤0.32 μm.

9. The steel strip, sheet or blank according to claim 1, wherein the optionally metallic coated strip, sheet or blank before the forming has a waviness Wsa≤0.29 μm.

10. The steel strip, sheet or blank according to claim 1, wherein Wsa(Flat) is ≤0.26 μm and Wsa(Formed) is ≤0.38 μm.

11. The steel strip, sheet or blank according to claim 1, wherein the surface of the strip has a roughness Ra lower than 2.0 μm and a Wsa(Flat)≤0.35 μm in rolling direction of the strip and Wsa (Formed) is ≤0.47 μm.

12. The steel strip according to claim 1, wherein Wsa (Flat) is between 0.15 and 0.35 μm.

13. The steel strip, sheet or blank according to claim 1, wherein the surface of the strip has a roughness Ra lower than 2.0 μm and a waviness 0.35 μm in rolling direction of the strip for a strip coated with an aluminium based coating having a coating thickness between 4 and 12 μm.

14. The steel strip, sheet or blank according to claim 1, wherein the steel has Sn from 0.001-0.01.

15. The strip produced with the method according to claim 7, wherein the surface of the strip has a roughness Ra lower than 2.0 μm and a waviness Wsa lower than 0.6 μm in rolling direction of the strip for the strip coated with an aluminium based coating having a coating thickness between 4 and 12 μm.

16. The method according to claim 7, wherein the roughness Ra of the work rolls in the last stand or the only stand is between 0.55 μm and 5.0 μm.

17. The method according to claim 7, wherein the cold rolling mill contains one stand, with work rolls having a roughness Ra between 0.5 μm and 7.0 μm.

18. The method according to claim 7, wherein the cold rolling mill contains two stands, the work rolls of the first stand having a roughness Ra between 0.6 μm and 3.0 μm, and the work rolls of the last stand having a roughness Ra between 0.5 μm and 7.0 μm.

19. The method according to claim 7, wherein the cold rolling mill contains three or more stands, the work rolls of the first stand having a roughness Ra between 0.6 μm and 3.0 μm, the work rolls of the intermediate stands having a roughness Ra between 0.3 μm and 0.8 μm and the work rolls of the last stand having a roughness Ra between 0.5 μm and 7.0 μm.

20. The method according to claim 7, wherein the cold rolled strip is skin passed, optionally after applying a metallic coating, using temper rolls having a roughness between 0.5 and 4.0 μm.

21. The method according to claim 7, wherein the roughness Ra of the work rolls in the last stand or the only stand is between 0.6 μm and 4.0 μm.

22. The method according to claim 7, wherein the roughness Ra of the work rolls in the last stand or the only stand is between 0.6 μm and 2.0 μm.

23. The method according to claim 7, wherein the cold rolling mill contains one stand, with work rolls having a roughness Ra between 0.55 μm and 5.0 μm.

24. The method according to claim 7, wherein the cold rolling mill contains one stand, with work rolls having a roughness Ra between 0.6 μm and 4.0 μm.

25. The method according to claim 7, wherein the cold rolling mill contains one stand, with work rolls having a roughness Ra between 0.6 μm and 2.0 μm.

26. The method according to claim 18, wherein the work rolls of the last stand have a roughness Ra between 0.55 μm and 5.0 μm.

27. The method according to claim 7, wherein the cold rolled strip is skin passed, after applying a metallic coating, using temper rolls having a roughness greater than 0.5 and ≤2.8 μm.

* * * * *